US005544678A

United States Patent [19]

Barrett

[11] Patent Number: 5,544,678

[45] Date of Patent: Aug. 13, 1996

[54] COMPOSITE FORMING FABRIC WOVEN WITH AN NX2N MACHINE SIDE LAYER

[75] Inventor: Rex Barrett, Peachtree City, Ga.

[73] Assignee: JWI Ltd., Kanata, Canada

[21] Appl. No.: 421,940

[22] Filed: Apr. 14, 1995

[51] Int. Cl.[6] ..... D03D 3/00

[52] U.S. Cl. ..... 139/383 A

[58] Field of Search ..... 139/383 A, 383 AA

[56] References Cited

U.S. PATENT DOCUMENTS

| | | | |
|---|---|---|---|
| 4,286,631 | 9/1981 | Strandly | 139/383 AA |
| 4,658,863 | 4/1987 | Errecart | 139/383 A |
| 4,815,499 | 3/1989 | Johnson . | |
| 5,022,441 | 6/1991 | Tate et al. | 139/383 A |
| 5,324,392 | 6/1994 | Tate et al. | 139/383 A X |
| 5,366,798 | 11/1994 | Ostermayer | 139/383 A X |
| 5,421,375 | 6/1995 | Praetzel | 139/383 A |

*Primary Examiner*—Andy Falik
*Attorney, Agent, or Firm*—Robert A. Wilkes

[57] ABSTRACT

A composite forming fabric, formed from two separate interconnected woven layers, for use in a paper making machine. The machine side layer is a single layer N by 2N weave, such as a six-shed, 6×12 weave. Within the weave repeat pattern the warp yarns form two distinct floats of unequal length, and the weft yarns form floats of equal or unequal length. The weft floats are located substantially in a single plane, on the machine side of the composite fabric. The weave design provides the composite fabric machine side layer with improved wear potential and guiding properties, without adversely affecting its drainage properties. The paper side fabric layer may be of any woven construction; a plain weave or 2/1 twill is preferred.

38 Claims, 7 Drawing Sheets

COMPOSITE FORMING FABRIC WOVEN WITH AN NX2N MACHINE SIDE LAYER

FIELD OF THE INVENTION

This invention relates to papermakers' composite forming fabrics.

BACKGROUND OF THE INVENTION

In the forming section of a paper making machine, an aqueous slurry of fibers and fillers is deposited onto the paper side of the forming fabric. The machine side of the forming fabric is in contact with the static parts of the paper making machine. The forming fabric allows water to drain through, while retaining a proportion of the fibers and fillers on its surface so that a very wet paper sheet is formed.

The introduction of plastics monofilaments allowed forming fabric design to diversify in a manner that was not possible earlier. This invention is concerned with one of the resulting fabric types, namely composite forming fabrics.

Composite forming fabrics comprise two essentially separate single layer woven structures that are interconnected into a unified fabric, as described in U.S. Pat. No. 4,815,499. The paper side layer is optimised for sheet forming, and the machine side layer is optimised for stability and wear resistance.

A composite forming fabric should have the following features in combination:

1) excellent wear potential, through careful selection of yarn sizes and materials, fabric mesh and weave design;
2) the yarns interconnecting the two layers should be removed as much as possible from the machine side area of wear;
3) the machine side layer weave design should not induce lateral tracking of the fabric when in use;
4) twinning of either or both the warp and weft yarns should be minimized by the weave design; and
5) the fabric seam should be strong and non-marking.

The term "wear potential" refers to the amount of yarn material that may, on average, be abraded away from the exposed machine side yarns before fabric replacement is necessary. In all forming fabrics the machine side of the fabric is exposed to abrasive wear, which will erode the machine side yarns to a point where those yarns become so thin that they are unable to provide the required tensile strength. The forming fabric must then be replaced. Any increase in the wear potential of a forming fabric is highly desirable.

Although increasing the size of the yarns in the machine side layer will generally increase fabric wear potential, this can result in a relatively thick forming fabric which tends to retain excess amounts of water.

It is also possible to increase the wear potential by increasing the length of the weft floats exposed on the machine side of a composite forming fabric. The float length can be increased by increasing the number of sheds in the machine side layer weave, and hence 3-, 4-, and higher shed designs are progressively "better" than 2-shed designs. Further, with higher shed numbers it is easier to obtain a large crimp differential. The term "crimp differential" refers to the essentially vertical distance between the most prominent warp yarn knuckle and the most prominent weft yarn knuckle. The value of the crimp differential is indicative of the order in which the machine side yarns begin to wear, and the amount of wear that is available. As the crimp differential increases, both mechanical stability and wear potential increase. The practical limit on float length in forming fabrics that are in commercial use today has been 4. Most composite forming fabric machine side layers are woven in 3, 4 or 5 sheds, with 5 shed satin designs being preferred. Designs that use 6 sheds, or more, have not been applied to the machine side layer of composite forming fabrics.

Composite forming fabrics having a machine side layer woven as a 3 or 4 shed twill exhibit "lateral tracking" and tend to drift laterally in use on the paper making machine in the direction of the twill, thereby increasing the difficulty of guiding the fabric in a straight run.

Another problem with composite forming fabrics having a machine side layer woven as a 4 shed cross or broken twill is that either the warps, or the wefts, have pronounced tendencies to pair, or twin. This reduces alignment and registration of the paper side and machine side yarns. The resulting different sized drainage passages adversely affects paper quality.

The manner in which the two layers of a composite forming fabric are interconnected also has an impact on wear potential. Failure of the interconnecting yarns results in delamination of the two layers. Two interconnection methods are used: additional binder yarns, or "intrinsic yarns". The chosen yarns can be either warps or wefts.

Additional binder yarns are yarns interwoven between the machine side and paper side layers during manufacture to bind them together. These binder yarns are usually of relatively smaller diameter than the machine side layer yarns, and will fail rapidly if exposed to abrasive wear. To minimize wear, the binder yarns are recessed as much as possible within the machine side layer structure.

"Intrinsic yarn" comprises an existing yarn, that already forms a portion of the paper side layer weave. The paths of selected yarns are modified so as to pass through both fabric layers. Intrinsic weft yarns are particularly suitable when the stock contains a relatively high amount of particulate filler material.

Although warp binder yarns are attractive because they are more economical, incorporating them into a composite forming fabric presents two difficulties to the manufacturer.

The paper side or machine side warp binders may cause discontinuities in the paper side surface, especially when the paper side layer is a plain weave and intrinsic warps are used. Second, if the machine side and paper side layer weave designs are quite different, the path lengths of adjacent or proximate warp yarns may not be identical. This method is more problematic and therefore is not generally preferred by manufacturers.

The seam is a weak point of any forming fabric, particularly when wear levels are high. Seams for flat woven forming fabrics are most often woven back seams. A high strength, non-marking seam is particularly difficult in composite forming fabrics.

SUMMARY OF THE INVENTION

The present invention seeks to provide a composite forming fabric, for a paper making machine, which comprises:

a) a paper side layer of interwoven warp and weft yarns;
b) a machine side layer of interwoven warp and weft yarns; and
c) interwoven binder yarns binding the paper side layer and the machine side layer together into a unified structure;

wherein in the machine side layer of the composite forming fabric:

i) the warp and weft yarns are woven according to a repeating multiple shed pattern which is an N by 2N weave in which N is the number of sheds and is an integer from 3 to 12 inclusive;

ii) the multiple shed pattern provides at least two distinct warp yarn floats having different float counts within one repeat of the weave pattern;

iii) the multiple shed pattern provides at least one distinct weft yarn float within one repeat of the weave pattern; and iv) all of the weft yarn floats are located substantially in a single plane and are exposed on the machine side of the machine side layer.

Preferably the composite fabric is a flat woven fabric incorporating a seam, and wherein the warps are in the machine direction and the wefts are in the cross-machine direction.

Preferably the ratio of the number of paper side layer warp yarns to the number of machine side layer warp yarns is from 2:1 to 1:1, and the ratio of the number of paper side layer weft yarns to the number of machine side layer weft yarns is from 4:1 to 1:1.

Preferably the machine side layer pattern provides distinct weft yarn floats all having the same float count. Alternatively, the machine side layer pattern provides at least two distinct weft yarn floats having different float counts.

Preferably the machine side layer pattern provides two distinct warp yarn floats having different float counts in all of the warp yarns. Alternatively, the machine side layer pattern provides at least three distinct warp yarn floats having different float counts in all of the warp yarns. Optionally, the machine side layer pattern provides at least two distinct warp floats having different float counts in a majority of the warp yarns, and provides warp floats having the same float count in the remainder of the warp yarns.

Preferably the interweaving yarns are weft yarns chosen from the group consisting of intrinsic weft yarns and weft binder yarns. Preferably the interweaving weft yarns are located in the machine side layer so that there is at least one weft yarn between the interweaving weft yarn and the end of the warp yarn float. Most preferably, the interweaving weft yarns are located in the machine side layer proximate the midpoint of the warp yarn float having the highest float count.

Alternatively, the interweaving yarns are warp yarns chosen from the group consisting of intrinsic warp yarns and warp binder yarns. Preferably the interweaving warp yarns comprise intrinsic warp binder yarns. Most preferably, the warp binder yarns are additional warp binder yarns, and are located adjacent to existing warp yarns in the paper side layer and the machine side layer.

Preferably, N has a value chosen from 4, 5, 6, 7 or 8. Most preferably, N is 6.

In a preferred embodiment, this invention seeks to provide a flat woven composite forming fabric incorporating a seam, wherein the warps are in the machine direction and the wefts are in the cross-machine direction, for a paper making machine, which fabric comprises:

a) a paper side layer of interwoven warp and weft yarns;

b) a machine side layer of interwoven warp and weft yarns; and c) interwoven binder yarns binding the paper side layer and the machine side layer together into a unified structure;

wherein in the machine side layer of the composite forming fabric:

i) the warp and weft yarns are woven according to a repeating six-shed 6×12 pattern which provides:

A) two distinct warp yarn floats having different float counts within one repeat of the weave pattern in each warp yarn, and B) at least one distinct weft yarn float within one repeat of the weave pattern in all of the weft yarns; and ii) all of the weft yarn floats are located substantially in a single plane, and iii) all of the weft yarn floats are exposed on the machine side of the machine side fabric layer.

Six-shed weave designs have not been applied to the machine side layer of composite forming fabrics. Prior to the present invention, it has not been possible to create a successful 6-shed pattern, such as a 6 shed satin weave, because the irregular nature of the weave designs causes twinning and unusual pairing of the machine side layer and paper side layer warp yarns. Most composite forming fabric machine side layers are woven in three, four or five sheds, with five shed satin designs being preferred.

Several unexpected benefits are provided by the machine side layer weave of the present invention.

Lateral tracking of the fabric on the paper making machine is improved. The machine side layer repeat pattern involving at least two warp floats having different float counts causes at least the majority, and preferably all, of the warp yarns to float within the machine side layer of the composite fabric over at least two distinctly different sets of weft yarns. For example, a 6-shed 6 by 12 weave, as is described below in more detail, can provide a repeat pattern in which the warp float counts are 4 and 6, thus creating an assymetrical array of warp knuckles on the exposed machine side of the machine side layer within the pattern repeat. This significantly reduces lateral drift. In prior art composite forming fabrics, the machine side layer has generally been constructed with constant float counts for each of the warp and weft floats.

The N by 2N weave design of this invention exhibits a reduced tendency to twin, a problem common to forming fabrics with machine side layers woven as 4-shed twills. The warp and weft yarns in the paper side layer and machine side layer remain in alignment and registration with one another, in a more or less stacked arrangement, particularly when the mesh count of the paper side layer is equal to the mesh count of the machine side layer. This provides for regular drainage openings in the composite fabric by enhancing the unobstructed "see-through" areas of the weave, and improves the sheet characteristics of the incipient paper web. These regular drainage openings also improve the cleaning efficiency of high pressure showers used to clean the forming fabric.

The N by 2N weave design of this invention also allows a woven back seam to be created in the composite forming fabric.

The creation of two warp floats having different float counts in the machine side layer creates unique areas for placing the seam yarn terminations that reduces the frequency of them along any particular row of terminations. The breaking up of the seam exit points under the weft allows for greater dispersion of the terminations. Any tendency for marking the paper sheet formed over the seam area is decreased by having this capability of decreasing frequency along any row of terminations. Seam strength is also enhanced by virtue of this increased variability.

In a second preferred embodiment of the invention, the interweaving yarns are chosen from additional weft binder yarns, and intrinsic weft binder yarns.

In a third broad embodiment of the present invention, the interweaving yarns are chosen from additional warp binder yarns, and intrinsic warp binder yarns.

Preferably, the weft binder yarns are located in an area created within the machine side layer by the warp floats having the highest float count, so as to recess and completely contain them within the fabric mesh system on the machine side of the composite fabric, and to protect them from abrasive wear. It is also possible to locate the weft binder yarns along machine side layer warp floats which do not have the highest warp float count. Any weft binder yarn should be located proximate the mid point of the warp yarn float, and should be located with at least one weft yarn between the weft binder yarn and the end of the warp yarn float. Thus for a warp float count of 3, the weft binder yarn has to be one side or the other of the middle weft, and a warp having a float count of 1 should not be used as the location for a weft binder yarn.

On the other hand, when the interweaving yarn is an added warp binder yarn, it is located adjacent an existing machine side layer warp yarn, so that it is protected from abrasion.

In a fourth broad embodiment of the present invention, the warp yarns in the machine side layer are substantially flat or rectangular in shape.

DETAILED DESCRIPTION OF THE DRAWINGS

In the following description and claims certain terms have the following meanings.

The term "paper side layer" refers to the layer in the composite forming fabric onto which the stock is deposited, and the term "machine side layer" refers to the layer in contact with the support means in the paper making machine. Thus each of these layers has a paper side and a machine side; the machine side of the paper side layer is in contact with the paper side of the machine side layer. Consequently, although a machine side layer warp float is referred to as "exposed", as it is on the paper side of the machine side layer, it is not exposed, but rather closely adjacent to the machine side of the paper side layer. A machine side layer weft float is exposed on the machine side of the machine side layer.

The term "machine direction", or "MD", refers to a line parallel to the direction of travel of the forming fabric when in use on the paper making machine, while the term "cross-machine direction", or "CD", refers to a direction transverse to this.

The "float count" is the number of yarns over which a length of yarn is exposed in the machine side layer of the forming fabric. In making the count, only yarns in the machine side layer are counted. The interweaving yarns are excluded in determining the float count.

The embodiments of the invention shown in the Figures will first be described in detail by reference to the design shown in FIGS. 1 through 6. In these Figures, the machine side layer is a 6-shed, 6 by 12 design.

Referring now to FIGS. 1 through 6, the machine side layer weft yarns have even numbers, the machine side layer warp yarns have odd number's, while the additional weft binder yarns are numbered from 101 up.

Figure 1:
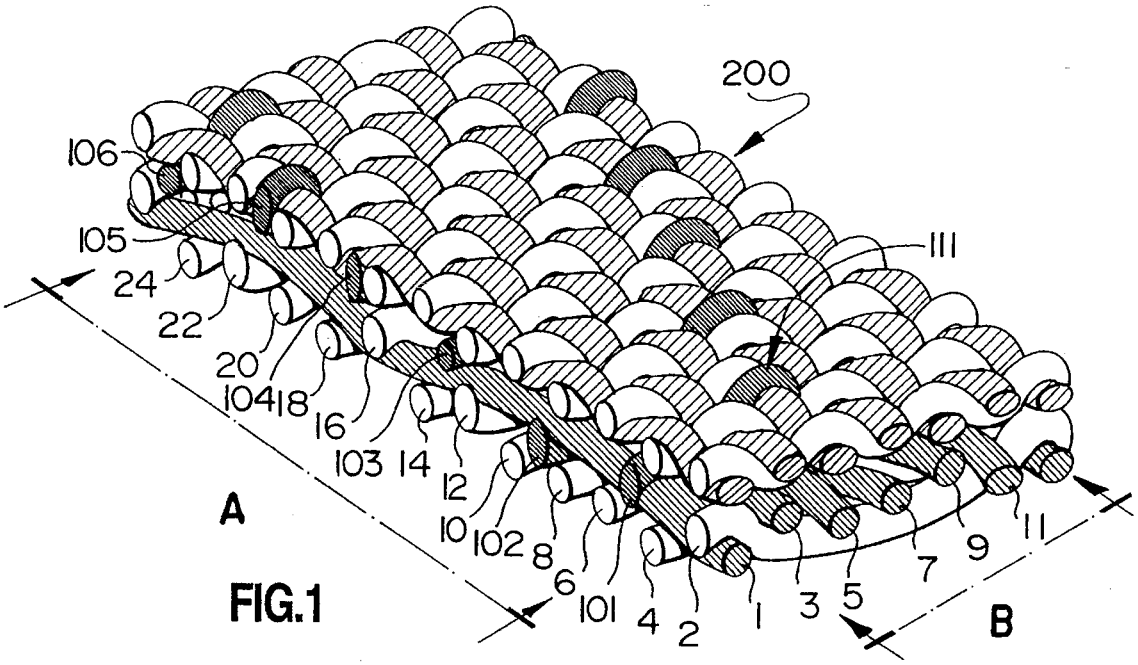
FIGS. 1 and 2 are orthographic projections a composite forming fabric of the present invention.
Figure 2:
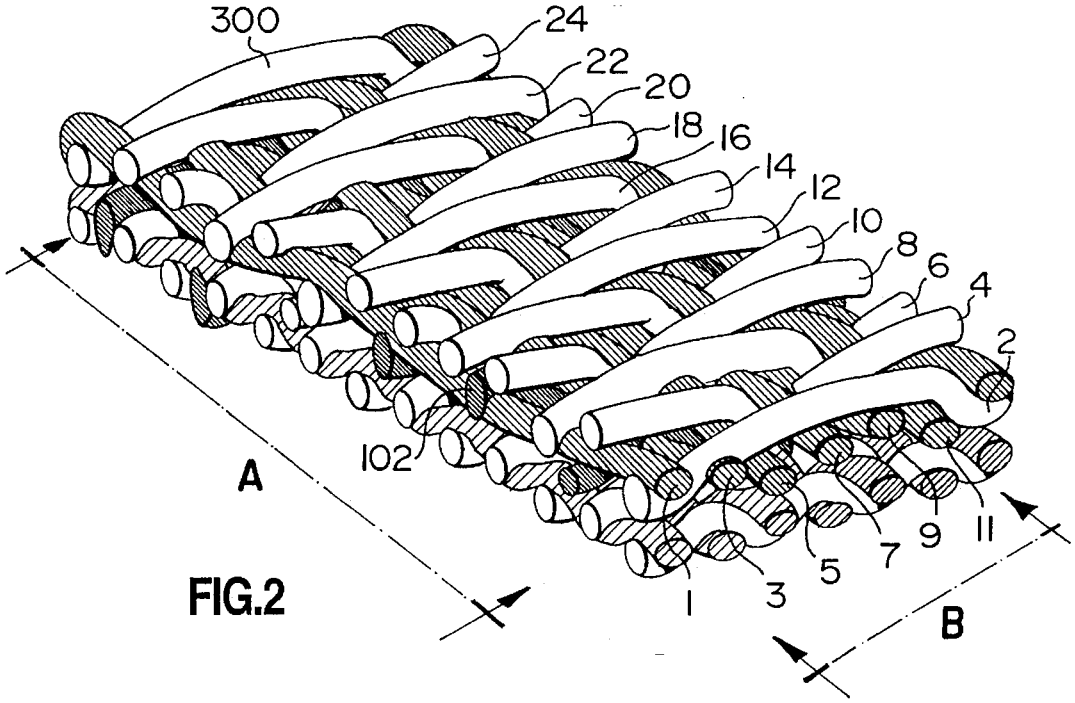

FIGS. 1 and 2 are orthographic projections of the two sides of the composite forming fabric.

In FIG. 1 the paper side layer 200 is a plain weave. The paper side layer may be of any weave construction as dictated by the requirements of the intended application, but a plain weave, or a 2/1 twill, are preferred.

In FIG. 2 the machine side layer 300 is a 6-shed, 6 by 12 weave.

In FIGS. 1 and 2 the paper side layer and the machine side layer are bound together by additional weft binder yarns.

In FIGS. 1 and 2 the machine side layer warp yarns are 1 through 11, the weft yarns are 2 through 24, and the weft binder yarns are 101 through 106. The additional weft binder yarns bind the paper side layer and the machine side layer together.

The path of warp yarn 1 in the machine side layer as shown in FIGS. 1 and 2 is typical. Warp yarn 1:

passes beneath machine side weft 2;

floats over six machine side wefts 4, 6, 8, 10, 12 and 14;

passes beneath machine side weft 16; and floats over machine side wefts 18, 20, 22 and 24.

It is thus apparent that although the warp 1, and the other warps in the machine side layer, float over two groups of weft yarns, these floats are concealed within the structure of the fabric. This machine side layer weave provides two distinct warp floats having float counts of 4 and 6 in each warp yarn.

The machine side layer is bound to the paper side layer by the additional weft binder yarns 101 through 106. The paths of these binder yarns will be discussed below with reference to FIGS. 3 and 5. In FIG. 1, weft binder yarn 102 is shown passing under the machine side layer warp yarn 1 at the longer of its two floats, between wefts 8 and 10. It can also be seen passing over the warp in the paper side layer at 111.

The path of weft yarn 2 in the machine side layer as shown in FIGS. 1 and 2 is typical. Weft yarn 2:

passes under warp 1; and floats over warps 3, 5, 7, 9 and 11.

Figure 3:
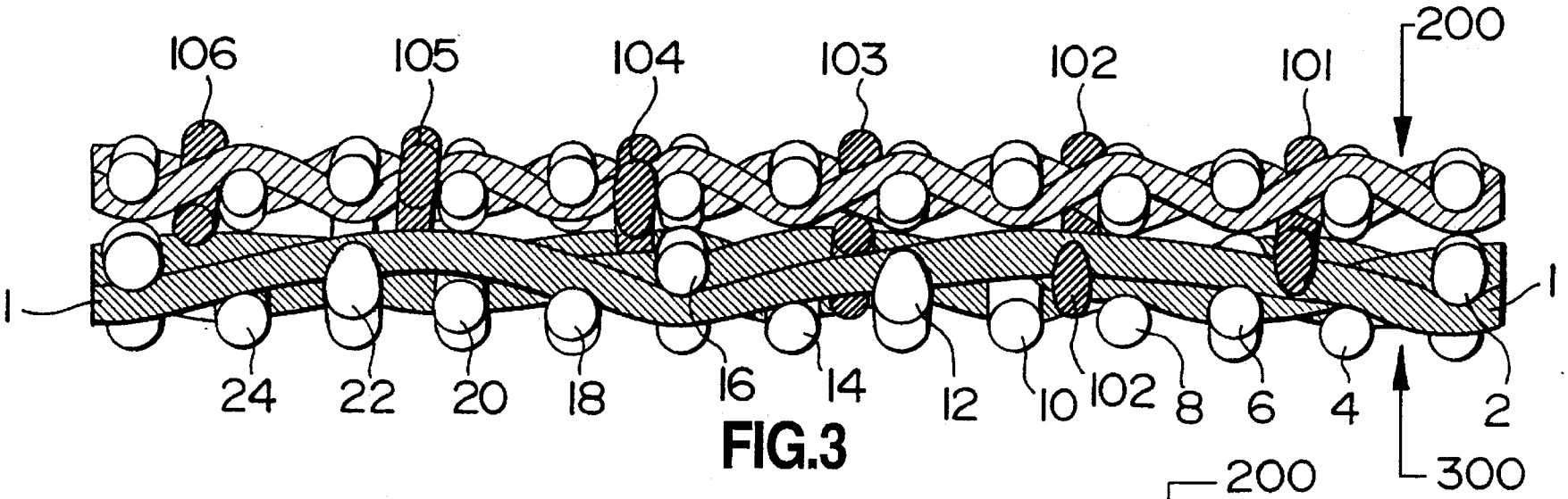
FIG. 3 is a cross-section taken along line A of the fabric shown in FIGS. 1 and 2.

Each of wefts 4 through 24 repeat this pattern. In each case the float count is constant, and is 5. Each of the weft floats is located substantially in a single plane, thus maximizing the amount of yarn material available to protect the warps 1–11 from abrasive wear. None of the additional weft binder yarns 101–106 appear on the machine side surface although, as FIG. 3 shows, each passes under the machine side of the machine side layer warps. The weft binder yarn knuckles are "buried" between adjacent weft floats, so as to protect it from abrasive wear. This can be seen from the locations of the wefts 8 and 10, the binder yarn 102 and the warp 1 in FIGS. 1 and 2.

In this weave design all of the weft float counts are the same. Unequal weft float lengths can be used in the machine side layer, as will be discussed below.

FIG. 3 is a cross-section of FIGS. 1 and 2 taken along line A. The paper side layer is at 200, and the machine side layer at 300. Warp yarn 1 floats under weft 2, over wefts 4, 6, 8, 10, 12 and 14, under weft 16, and then over wefts 18, 20, 22 and 24, giving warp float counts of 4 and 6. Additional weft binder yarns 101, 102, 103, 104, 105 and 106 bind the paper side plain weave layer to the machine side layer. Weft binder yarn 102 is located at the center of the longer float in warp 1 between wefts 8 and 10 in a recessed position so as to protect it. When the fabric is used in a papermaking machine, the exposed floats of the machine side weft yarns 2–24, and a portion of warp yarn 1 at the knuckle formed at weft 16, will wear away before the weft binder yarns 101–106 are exposed to abrasion.

Figure 4:
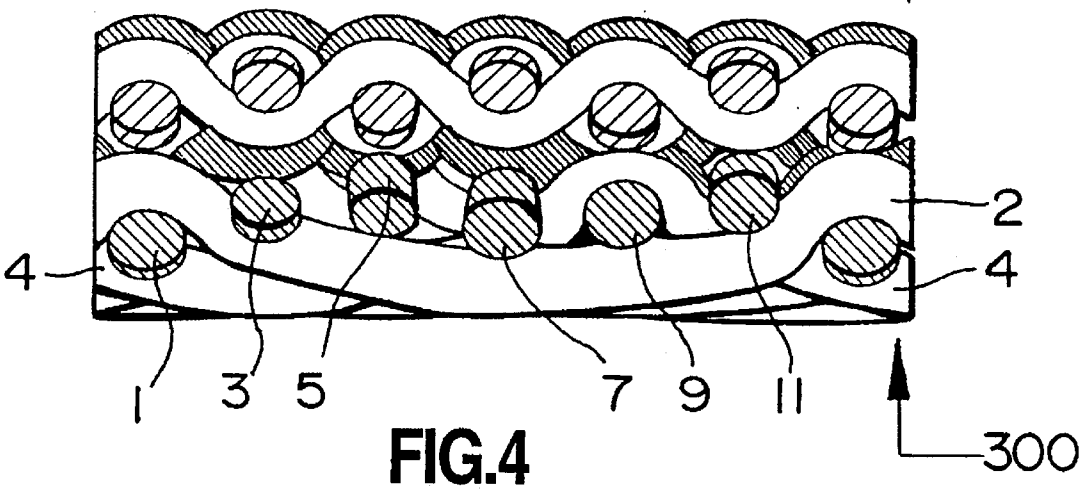
FIG. 4 is a cross-section taken along line B of the fabric shown in FIGS. 1 and 2.

FIG. 4 is a cross-section of FIGS. 1 and 2 along line B. The paper side fabric layer is at 200, and the machine side layer is at 300.

The path of weft yarn 2 in the machine side layer as shown in FIG. 4 is typical. Weft yarn 2:

passes under warp 1; and floats over warps 3, 5, 7, 9, and 11.

Warp 1 is recessed from the plane of wear by weft 4. In this weave design all of the weft yarn floats have a float count of 5, and are located in substantially the same plane in the machine side layer.

Figure 5:
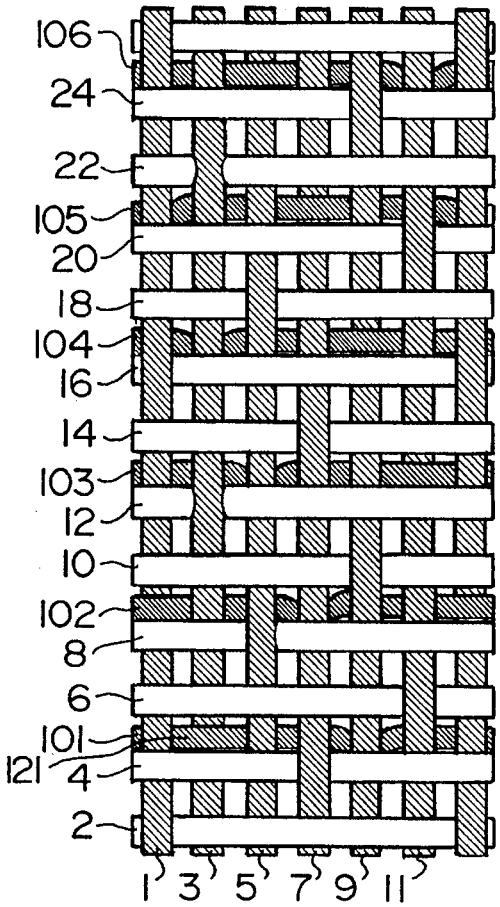
FIG. 5 is a planar projection of the paper side of the fabric shown in FIGS. 1 and 2.
Figure 6:
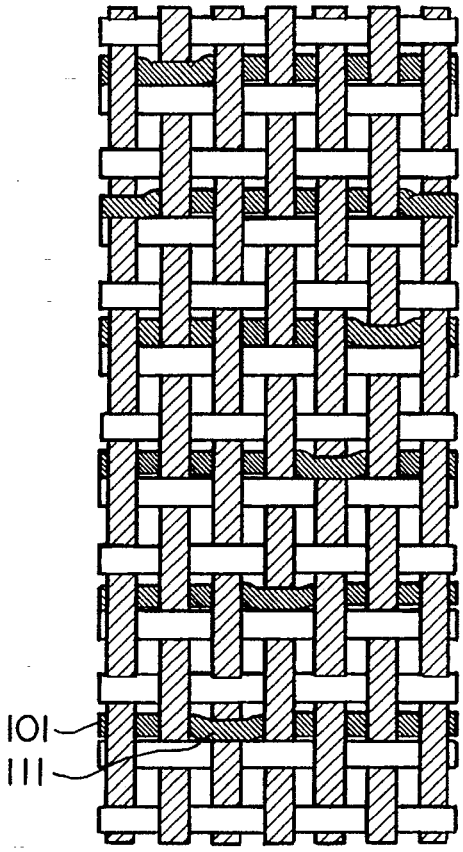
FIG. 6 is a planar projection of the machine side of the fabric shown in FIGS. 1 and 2.

FIGS. 5 and 6 are planar projections of the machine side and paper side surfaces respectively of the composite forming fabric shown in FIGS. 1 and 2. The binder yarn knuckles can be seen to follow a regular pattern offset from the machine side layer and paper side layer wefts.

In FIG. 5 both the machine side weft yarn floats which provide the increased wear potential, and the remainder of the binder yarn paths are shown.

Although the exposed weft floats all have the same float count, the lateral displacement of the floats in wefts 2 through 24 is not regular from one weft to the next; there are no twill lines which would cause the fabric to drift laterally when in operation.

The remainder of the path of additional weft binder yarn 101 can also be seen. It passes over the machine side of warp 3 at 121, and at that point is almost buried in the machine side of the machine side layer: the knuckle formed where binder yarn 101 passes over warp 3 is almost invisible, as can be seen from FIG. 2, as are the similar knuckles formed by the other binder yarns 102–106. In this way the binder yarns which bind the two layers of the composite forming fabric together are protected from abrasion by the various surfaces that support the forming fabric.

In FIG. 6 the first part of the path of the additional weft binder yarn 101 is shown. It is taken over a paper side layer warp, at 111, to bind the paper side layer to the machine side layer. This point in the weave the binder yarn 101 is visible, as can also be seen in FIG. 1.

The preceding description of the embodiment in FIGS. 1 and 2 shows in detail how a composite forming fabric according to this invention is created. As these Figures show, this invention provides a better weave design for the machine side layer in a composite forming fabric.

Figure 7:
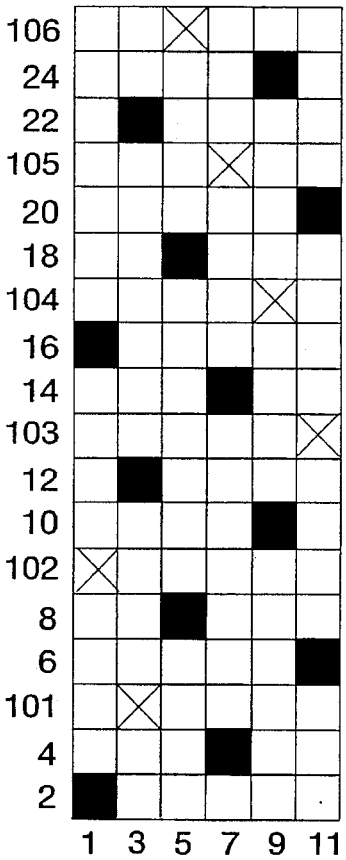
FIGS. 7 through 19 show machine side layer weave patterns.
Figure 9:
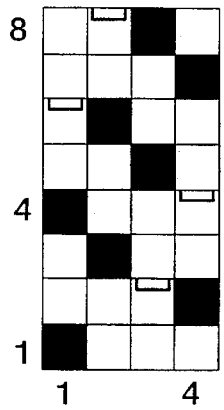

In FIGS. 7 through 19 machine side layer weave designs are shown by way of conventional diagrams. In FIG. 7 the warp and weft yarns are numbered to match FIGS. 1–6. In FIGS. 7–19 the warps are vertical, and the wefts are horizontal. In FIG. 7, which is the weave design shown in FIGS. 1 and 2, the binder yarns are shown, and the yarns are numbered as in FIGS. 1 and 2. In FIGS. 8–19 both sets of yarns are numbered from 1 up, from the bottom left corner. The positions of the binder yarns are also indicated by the "[" markings. In FIGS. 7–19 a black square indicates a weft passes over a warp at that point, so that there is a warp knuckle exposed on the machine side of the machine side layer at that point. In FIG. 7 an "X" indicates that the weft binder yarn passes over a warp at that point; the remainder of the binder yarn path is not shown.

In FIG. 7 the assymetrical nature of the weft float within the weave pattern repeat can be seen more clearly than in FIG. 6. Although the weft float count is constant at 5, the black squares show that each float is not offset by the same amount relative to its neighbours on each side. It is this level of assymetry which substantially eliminates lateral tracking in the composite fabrics of this invention. In FIG. 7 the warp float counts are 4 and 6, with the binder yarns located at the middle of the longest warp floats, for example between wefts 8 and 10 on warp 1. The weft float count is constant at 5.

The weave patterns in FIGS. 8–19 are summarized in Table 1. FIG. 7 is also included.

TABLE 1

| Figure | N × 2N | Warp Float Counts | Weft Float Counts |
|---|---|---|---|
| 7 | 6 × 12 | 6 and 4. | 5. |
| 8 | 3 × 6 | 1, 2 and 3. | 2. |
| 9 | 4 × 8 | 2 and 4. | 3. |
| 10 | 5 × 10 | 2 and 6. | 4. |
| 11 | 6 × 12 | 5. | 5. |
| | | 4 and 6. | |
| 12 | 7 × 14 | 2 and 10. | 6. |
| 13, 14 | 8 × 16 | 2 and 12. | 7. |
| 15 | 8 × 16 | 2, 1, 4 and 5. | 2 and 4. |
| 16 | 9 × 18 | 4 and 12. | 8. |
| 17 | 10 × 20 | 6 and 12. | 9. |
| 18 | 11 × 22 | 8 and 12. | 10. |
| 19 | 12 × 24 | 4 and 18. | 11. |

Table 1 shows three other features of this invention which are not present in the composite forming fabric of FIGS. 1 and 2.

Figure 11:
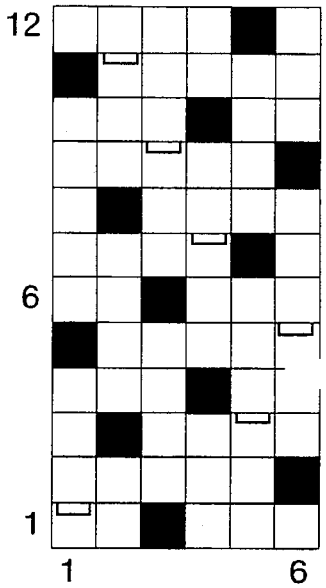
Figure 8:
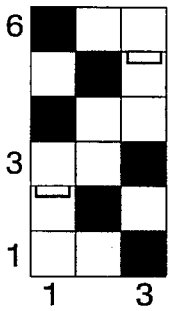
Figure 10:
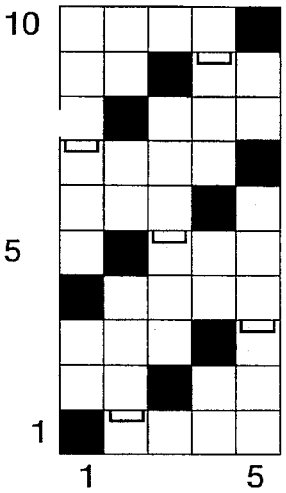
Figure 12:
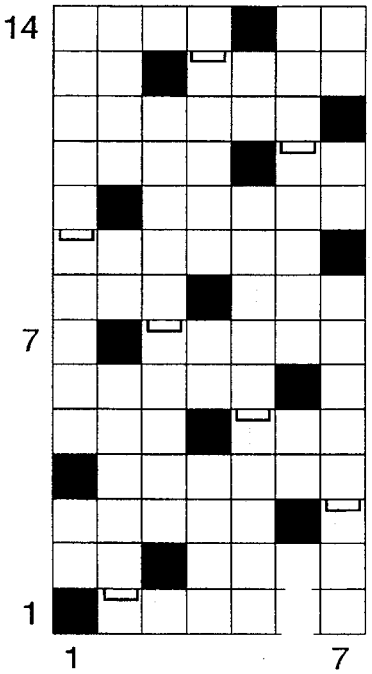

In FIGS. 8 and 11 while the weft float counts are all the same, at 2 (FIG. 8) and 5 (FIG. 11), there are three warp float counts. In FIG. 8, warp yarns 1 and 3 have unequal float lengths, with float counts of 1 and 3, and warp yarn 2 has equal floats with a float count of 2. In FIG. 11, warp yarns 1 and 4 both have equal length floats, with a float count of 5. Warp yarns 2, 3, 5, and 6 all have unequal float lengths, with float counts of 4 and 6. Hence the unequal warp floats of this invention do not have to be in all of the yarns: what is required is that within the weave pattern repeat all of the warp floats are not equal, which results in the required assymetry within the weave repeat pattern.

Figure 15:
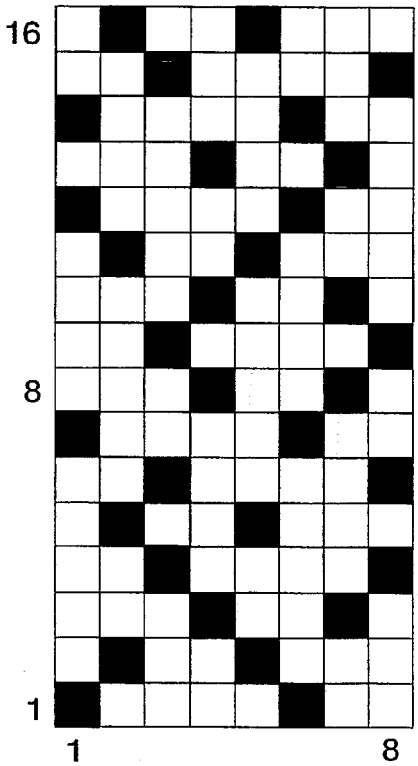
Figure 16:
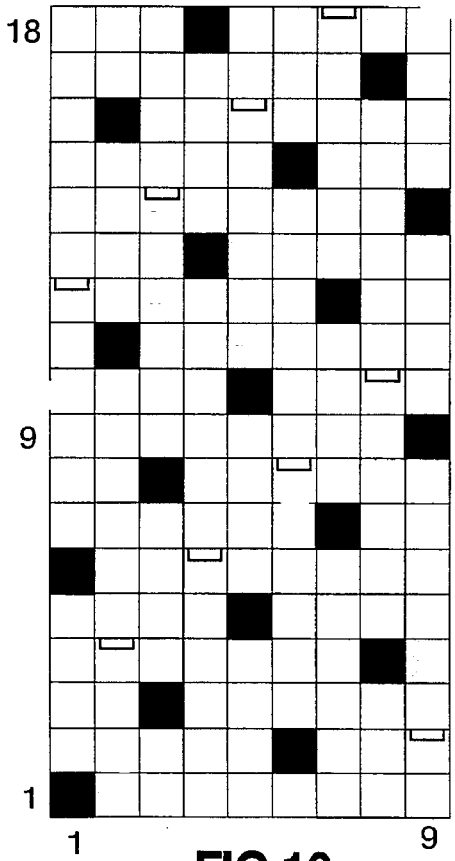
Figure 17:
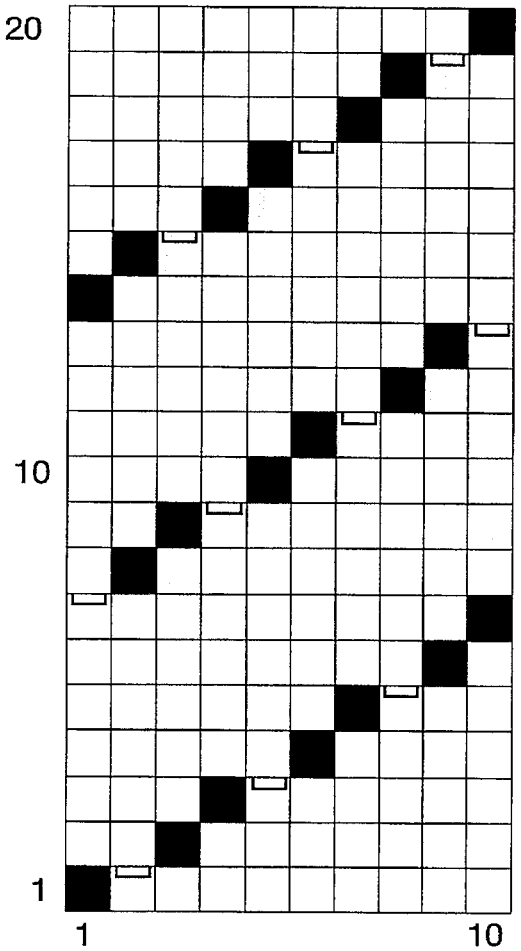
Figure 18:
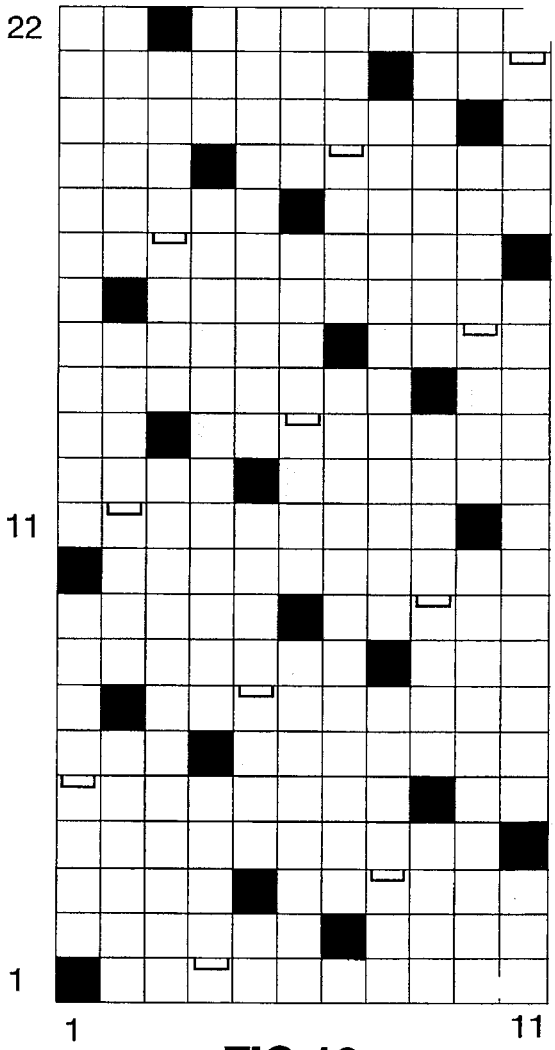

In FIG. 15 there are two further changes. First, the weft float counts are unequal. The weft float counts are 2 and 4. Second, there are four different warp float counts. Warp 2 is typical, and shows the four different float counts to be in sequence 1, 2, 5 and 4. This combination results in a very assymetric, almost random, pattern within the weave pattern repeat.

In FIGS. 7–13, and 16–19 the positions of the interweaving binder yarns are also shown.

Figure 19:
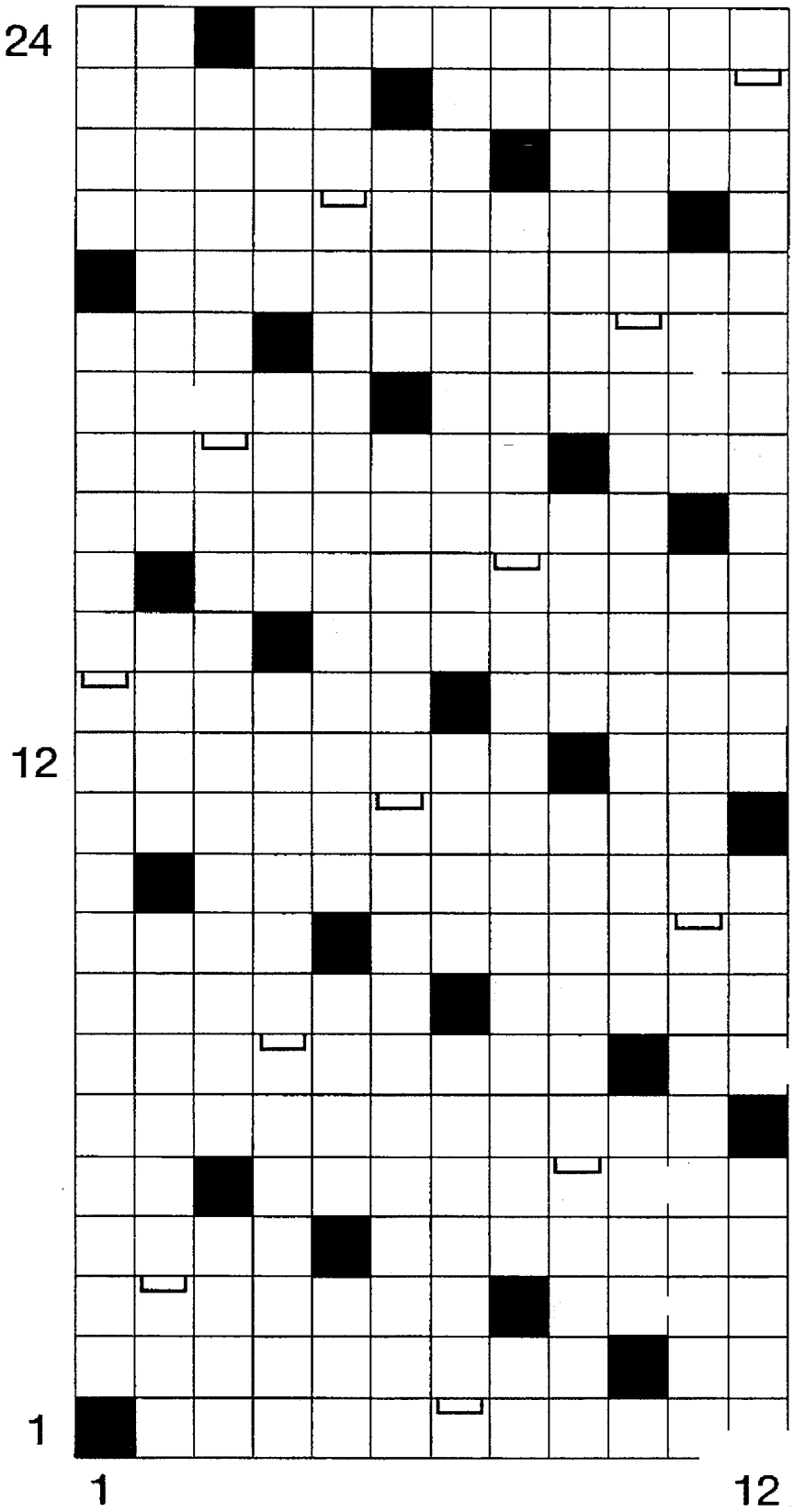

FIG. 7 is discussed above; in FIGS. 7–13 and 16–19 the positions of additional weft binder yarns are shown. It can be seen that in each case the weft binder yarn is located in the preferred position, that is at or close to the midpoint of the warp float with the highest warp count. This position is much the same as that shown in FIGS. 1 and 2; it is adopted to provide the best possible protection to the knuckle in the weft binder yarn as it passes over the warp by burying it into the machine side of the fabric. As the value of N increases, the available warp float length also increases, as FIGS. 7–19 show: FIG. 19 shows a 12×24 pattern with a warp float count of 18 for the longest float, which is three times higher than that in FIGS. 1 and 2, and six times that of FIG. 8. With floats of this length, the weft binder yarn can be located at positions other than at the midpoint, or adjacent the midpoint where the float count is an odd number. The limitation appears to be that there should be at least one warp between a weft binder yarn and the end of the warp float. It is nevertheless preferred that the weft binder yarn be proximate the midpoint of the warp float with the highest float count for maximum protection of the weft binder yarn.

Figure 13:
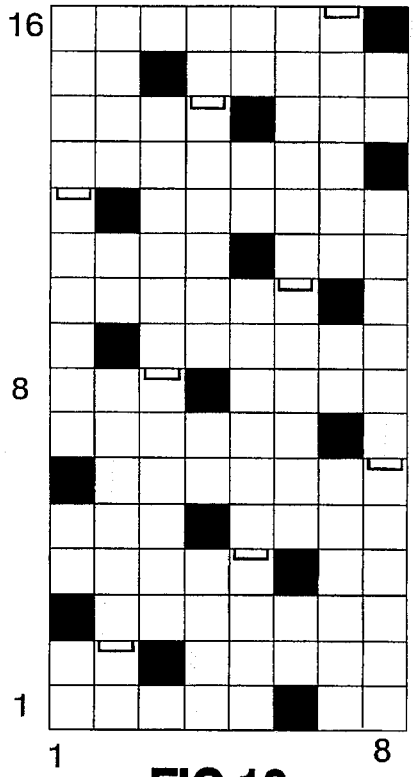
Figure 14:
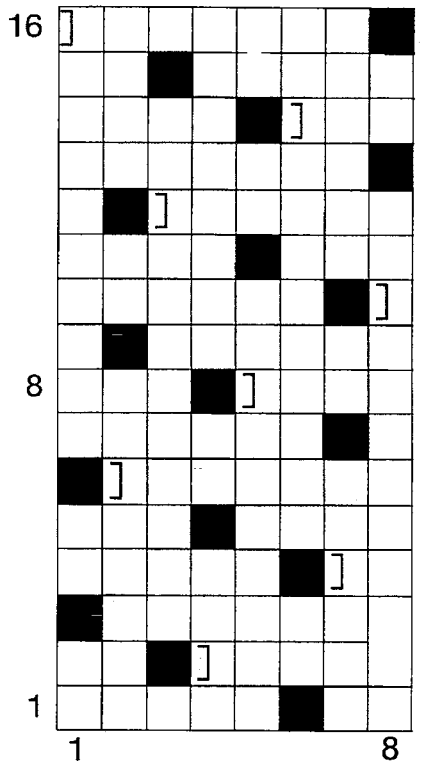

FIGS. 13 and 14 both show the same 8×16 weave pattern. The difference is in the interweaving yarns. In FIG. 13 weft binder yarn positions are shown; in FIG. 14 the positions for additional warp binder yarns are shown. In order to protect them as much as possible, they pass under the wefts beside the warps, so that the warp and warp binder knuckles are beside each other.

Fabric Trials

In both Trials, the fabrics were woven from polyethylene terephthalate monofilaments with the specified dimensions. Both fabrics were woven according to the design shown in FIGS. 1 and 2, with a plain weave as the paper side layer.

Trial I

The paper side layer was woven using 0.20 mm diameter circular warp yarns and 0.19 mm diameter circular weft yarns. The machine side layer was woven using 0.27 mm diameter circular warp yarns and 0.28 mm diameter circular weft yarns. The mesh of both layers of the fabric (MD×CD yarns) was 25.6 ×20.5 yarns/cm. The fabric exhibited excellent wear potential and showed no tendency to drift laterally while in use on the paper making machine. The fabric also exhibited excellent resistance to stretching and narrowing.

Trial II

The paper side layer was woven using 0.16 mm diameter circular warp and weft yarns. The machine side layer was woven using 0.59×0.21 mm (width×thickness) rectangular warp yarns and 0.20mm diameter weft yarns. The mesh of both layers of the fabric was 28×26 yarns/cm. This fabric also exhibited excellent wear potential and did not drift laterally in operation.

The invention may also incorporate other ratios of paper side to machine side wefts. These Trial fabrics are woven with a 1:1 yarn ratio between the paper side layer and the machine side layer for both warps and wefts. Other suitable paper side layer to machine side layer weft ratios include 4:1, 3:2, 3:1, and 2:1. Similarly, suitable paper side layer to machine side layer warp ratios include values ranging from 2:1 to 1:1.

The fabrics of the present invention are woven using yarns and weaving methods well known in this art. The yarns may be chosen from monofilament polymeric yarns comprised of polyethylene terephthalate, nylons such as nylon 6 and nylon 66, or polymer blends and alloys, such as blends of polyethylene terephthalate with a polyurethane elastomer. These monofilaments may be substantially round, rectangular, ovate or elliptical and may be employed in one or both of the machine side layer or paper side layer weave construction. Mesh counts other than those described herein may be used.

We claim:

1. A composite forming fabric, for a paper making machine, which comprises:

a) a paper side layer of interwoven warp and weft yarns;

b) a machine side layer of interwoven warp and weft yarns; and c) interwoven binder yarns binding the paper side layer and the machine side layer together into a unified structure;

wherein in the machine side layer of the composite forming fabric:

i) the warp and weft yarns are woven according to a repeating multiple shed pattern which is an N by 2N weave in which N is the number of sheds and is an integer from 3 to 12 inclusive;

ii) the multiple shed pattern provides at least two distinct warp yarn floats having different float counts within one repeat of the weave pattern;

iii) the multiple shed pattern provides at least one distinct weft yarn float within one repeat of the weave pattern;

iv) all of the weft yarn floats are located substantially in a single plane and are exposed on the machine side of the machine side layer, and v) all of the ward yarn floats are located substantially in a single plane and are exposed on the paper side of the machine side layer in contact with the machine side of the paper side layer.

2. A fabric according to claim 1 wherein the ratio of the number of paper side layer warp yarns to the number of machine side layer warp yarns is from 2:1 to 1:1, and the ratio of the number of paper side layer weft yarns to the number of machine side layer weft yarns is from 4:1 to 1:1.

3. A fabric according to claim 1 wherein the machine side layer pattern provides distinct weft yarn floats all having the same float count.

4. A fabric according to claim 1 wherein the machine side layer pattern provides at least two distinct weft yarn floats having different float counts.

5. A fabric according to claim 1 wherein the machine side layer pattern provides in each warp yarn two distinct warp yarn floats having different float counts.

6. A fabric according to claim 1 wherein the machine side layer pattern provides in each warp yarn at least three distinct warp yarn floats having different float counts.

7. A fabric according to claim 1 wherein the machine side layer pattern provides at least two distinct warp floats having different float counts in a majority of the warp yarns, and provides warp floats having the same float count in the remainder of the warp yarns.

8. A fabric according to claim 1 wherein the interweaving yarns are weft yarns chosen from the group consisting of intrinsic weft yarns and additional weft binder yarns.

9. A fabric according to claim 8 wherein the interweaving weft yarns are located so that there is at least one weft yarn between the interweaving weft yarn and the end of the warp yarn float.

10. A fabric according to claim 1 wherein the interweaving yarns are warp yarns chosen from the group consisting of intrinsic warp yarns and additional warp binder yarns.

11. A fabric according to claim 10 wherein the interweaving yarns comprise additional warp binder yarns.

12. A fabric according to claim 11 wherein the warp binder yarns are additional warp binder yarns, and are located adjacent an existing warp yarn in the machine side layer.

13. A fabric according to claim 8 wherein the machine side layer pattern provides in each warp yarn two distinct warp yarn floats having different float counts, and the interweaving weft yarns are located proximate the midpoint of the warp yarn float having the higher float count.

14. A fabric according to claim 8 wherein the machine side layer pattern provides in each warp yarn two distinct warp yarn floats having different float counts, and the interweaving weft yarns are located proximate the midpoint of the warp yarn float having the lower float count.

15. A fabric according to claim 8 wherein the machine side layer pattern provides in each warp yarn three distinct warp yarn floats having different float counts, and the interweaving weft yarns are located proximate the midpoint of the warp yarn float having the highest float count.

16. A fabric according to claim 8 wherein the machine side layer pattern provides in each warp yarn three distinct warp yarn floats having different float counts, and the interweaving weft yarns are located proximate the midpoint of a warp yarn float other than the warp yarn float having the highest float count.

17. A fabric according to claim 8 wherein the machine side layer pattern provides at least two distinct warp floats having different float counts in a majority of the warp yarns, and provides warp floats having the same float count in the remainder of the warp yarns, and the interweaving weft yarns are located proximate the midpoint of the higher of the at least two distinct warp yarn floats having different float counts, and proximate the midpoint of the warp floats having the same float count.

18. A fabric according to claim 8 wherein the machine side layer pattern provides at least two distinct warp floats having different float counts in a majority of the warp yarns, and provides warp floats having the same float count in the remainder of the warp yarns, and the interweaving weft yarns are located proximate the midpoint of the lower of the at least two distinct warp yarn floats having different float counts, and proximate the midpoint of the warp floats having the same float count.

19. A fabric according to claim 1 wherein the ratio of the number of paper side layer weft yarns to the number of machine side layer weft yarns is 4:1, 3:1, 2:1, 5:3, 3:2, 5:4 or 1:1.

20. A fabric according to claim 1 wherein the ratio of the number of paper side layer warp yarns to machine side layer warp yarns is 2:1, 3:2 or 1:1.

21. A fabric according to claim 1 wherein N has a value chosen from 4, 5, 6, 7 or 8.

22. A fabric according to claim 1 wherein N is 6.

23. A flat woven composite forming fabric incorporating a seam, wherein the warps are in the machine direction and the wefts are in the cross-machine direction, for a paper making machine, which comprises:

a) a paper side layer of interwoven warp and weft yarns;

b) a machine side layer of interwoven warp and weft yarns; and c) interwoven binder yarns binding the paper side layer and the machine side layer together into a unified structure;

wherein in the machine side layer of the composite forming fabric:

i) the warp and weft yarns are woven according to a repeating six-shed 6×12 pattern which provides:

A) two distinct warp yarn floats of having different float counts within one repeat of the weave pattern in each warp yarn, and B) at least one distinct weft yarn float within one repeat of the weave pattern in all of the weft yarns; and ii) all of the weft yarn floats are located substantially in a single plane, iii) all of the weft yarn floats are exposed on the machine side of the machine side fabric layer, and iv) all of the warp yarn floats are located substantially in a single plane and are exposed on the paper side of the machine side layer in contact with the machine side of the paper side layer.

24. A fabric according to claim 23 wherein the ratio of the number of paper side layer warp yarns to the number of machine side layer warp yarns is from 2:1 to 1:1; and the ratio of the number of paper side layer weft yarns to the number of machine side layer weft yarns is from 4:1 to 1:1.

25. A fabric according to claim 23 wherein the two different float counts are 4 and 6.

26. A fabric according to claim 23 wherein within one repeat of the weave pattern all the distinct weft yarn floats have the same float count.

27. A fabric according to claim 26 wherein the weft yarn float count is 5.

28. A fabric according to claim 23 wherein the interweaving yarns are weft yarns chosen from the group consisting of intrinsic weft yarns, and additional weft binder yarns.

29. A fabric according to claim 28 wherein the interweaving yarns are additional weft binder yarns.

30. A fabric according to claim 29 wherein the two different warp yarn float counts are 4 and 6.

31. A fabric according to claim 30 wherein the weft binder yarns are located proximate the midpoint of the warp yarn float having a float count of 6.

32. A fabric according to claim 30 wherein the weft binder yarns are located proximate the midpoint of the warp yarn float having a float count of 4.

33. A fabric according to claim 29 wherein the machine side layer pattern provides at least two distinct warp floats having different float counts in a majority of the warp yarns, and provides warp floats having the same float count in the remainder of the warp yarns, and the weft binder yarns are located proximate the midpoint of the higher of the at least two distinct warp yarn floats having different float counts, and proximate the midpoint of the warp floats having the same float count.

34. A fabric according to claim 29 wherein the machine side layer pattern provides at least two distinct warp floats having different float counts in a majority of the warp yarns, and provides warp floats having the same float count in the remainder of the warp yarns, and the weft binder yarns are located proximate the midpoint of the lower of the at least two distinct warp yarn floats having different float counts, and proximate the midpoint of the warp floats having the same float count.

35. A fabric according to claim 29 wherein the machine side layer pattern provides at least two distinct warp floats having float counts of 4 and 6 in a majority of the warp yarns, and provides warp floats having a float count of 5 in the remainder of the warp yarns, and the weft binder yarns are located proximate the midpoint of the warp yarn floats having float counts of 5 and 6.

36. A fabric according to claim 29 wherein the machine side layer pattern provides at least two distinct warp floats having float counts of 4 and 6 in a majority of the warp yarns, and provides warp floats having a float count of 5 in the remainder of the warp yarns, and the weft binder yarns are located proximate the midpoint of the warp yarn floats having float counts of 4 and 5.

37. A fabric according to claim 23 wherein the ratio of the number of paper side layer weft yarns to the number of machine side layer weft yarns is 4:1, 3:1, 2:1, 5:3, 3:2, 5:4 or 1:1.

38. A fabric according to claim 23 wherein the ratio of the number of paper side layer warp yarns to machine side layer warp yarns is 2:1, 3:2 or 1:1.

* * * * *